United States Patent [19]

Lorenz et al.

[11] 3,931,696

[45] Jan. 13, 1976

[54] DEVICE FOR MAKING SECTIONS FOR SPECIMENS AND SPECIMEN SUPPORTS THEREFOR

[75] Inventors: Wolfgang Lorenz; Heinz Strubig, both of Rathenow, Germany

[73] Assignee: VEB Rathenower Optische Werke, Rathenow, Germany

[22] Filed: Mar. 4, 1974

[21] Appl. No.: 447,655

[52] U.S. Cl. ..... 51/131; 51/216 T; 51/237 R

[51] Int. Cl.[2] ..... B24B 37/04

[58] Field of Search ..... 51/129, 131, 132, 133, 51/216 T, 237 R

[56] References Cited

UNITED STATES PATENTS

| | | | |
|---|---|---|---|
| 2,839,877 | 6/1958 | Boettcher | 51/131 |
| 2,971,298 | 2/1961 | Garthwaite | 51/131 |
| 3,431,683 | 3/1969 | Wright | 51/131 X |
| 3,505,766 | 4/1970 | Boettcher | 51/131 X |

*Primary Examiner*—Al Lawrence Smith
*Assistant Examiner*—Nicholas P. Godici
*Attorney, Agent, or Firm*—Tab T. Thein

[57] ABSTRACT

Device for making sections for specimens and specimen support therefor, namely for thin sections and ground surfaces of metallographic specimens for microscopic analyses. The device includes a rotatable polishing wheel with at least two of the specimen supports disposed thereabove, and frictional drive means centrally located with respect to the wheel, wherein the specimen supports have assigned thereto at least one roller for driving a pair of adjacent supports, the latter as well as the rollers having complementary engaging peripheral surfaces that are partly cylindrical and partly conical, and means for adjusting the location and degree of interengagement between the respective surfaces.

13 Claims, 3 Drawing Figures

DEVICE FOR MAKING SECTIONS FOR SPECIMENS AND SPECIMEN SUPPORTS THEREFOR

Figure 1:
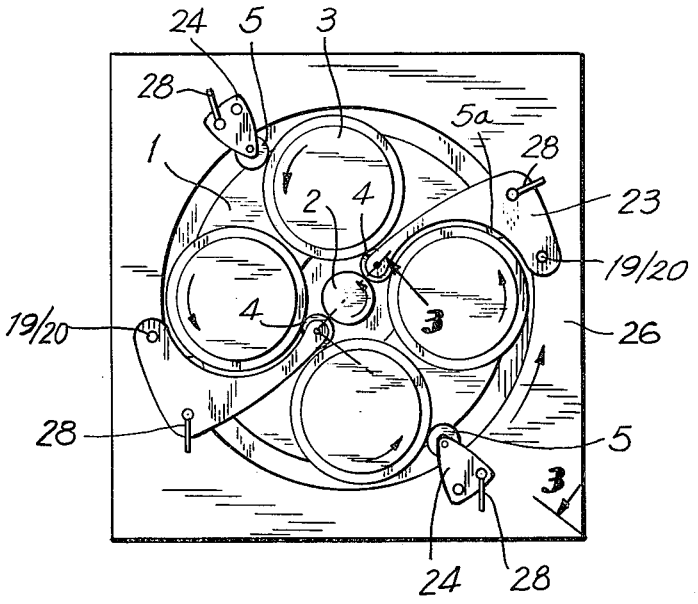

The invention relates to devices for making planar and/or plan-parallel sections, particularly for preparing metallographic specimens for microscopic analyses. Specifically, the invention also relates to specimen supports to be used in such devices, and to their drive and adjusting means.

When making qualitative and quantitative analyses of compound substances one uses predominantly microscopic tests. To this end thin sections and ground surfaces are respectively required which can be examined in transillumination or top illumination, according to the test method being used.

Certain requirements are made in respect of such specimens or preparations. Thus, for example, the surfaces have to be planar and substantially plan-parallel for thin sections, with the requirement of the section thicknesses being adjustable and reproducible. Abrasion or material-removal processes other than grinding and polishing are less suitable because it is important to avoid the possible shifting and smearing of the inner structures.

In order to obtain a surface which is free from embossment or relief and scratches, and having only minimum roughness depths, special grinding or polishing pastes or corresponding wheel or disc materials are required. The kinematic conditions also have to be kept at an optimum for maintaining the planar surfaces with economic operating conditions, such as constant values of revolution, correlated diameters and balanced mass conditions.

These requirements cannot be fulfilled with the hitherto known state of the art, or they can be realized only in part.

It is well known that specimens of this kind have to be kept in appropriate cages, processed on rotating polishing wheels or discs by the aid of loose grinding materials, in order to achieve planar surfaces having minimum roughness depths.

This working principle does not lend itself to adaptation to the area of preparing thin sections and ground surfaces for mineralogy because different force conditions occur, such as for example when grinding metals from which metallographic specimens are prepared, e.g. for microscopic analyses.

It is also known, particularly for the reproducible preparation of thin sections, to adjust their thicknesses such that three limiting pins are made to directly touch the plan-parallel annular surface of the specimen holder or the surface of the polishing wheel when the grinding or polishing process is completed. These pins are directly coupled to the lowering or feeding process of the specimens. Although this manner of setting the thickness allows a certain subsequent correction of non-parallelism, it is rather cumbersome, time-consuming and basically prone to errors because the same adjustment of the limiting pins has to be performed at three different locations. The possibility of an erroneous adjustment is not eliminated either by directly or indirectly coupling the adjusting movement of the pins by the aid of precision measuring devices.

It is therefore an object of the present invention to eliminate the described disadvantages and drawbacks as far as possible. The invention aims at providing a simple yet reliable structure for supporting specimens.

The inventive specimen supports are suitable for the new devices which latter include the usual housing, rotatable polishing wheel, frictional driving roller means in the center of the wheel. The supports themselves are characterized in that they have assigned thereto at least one driving roller for two adjacent supports, the latter as well as the roller having complementary engaging peripheral surfaces that are partly cylindrical and partly conical, and means for adjusting the location and degree of interengagement between the respective surfaces.

Other, optional and secondary features of the invention will become clear from the specification, in respect of preferred, exemplary embodiments of the devices and the supports, which latter respectively serve for the preparation of accurately reproducible thin sections, and for precisely ground specimen surfaces, also for microscopic analyses.

It should be mentioned at this point that the present invention is related to some extent to the simultaneously filed patent application of the inventors D. Welsch and H. Waschull, titled "Device for Mounting Specimens", U.S. Ser. No. 447,684.

Figure 2:
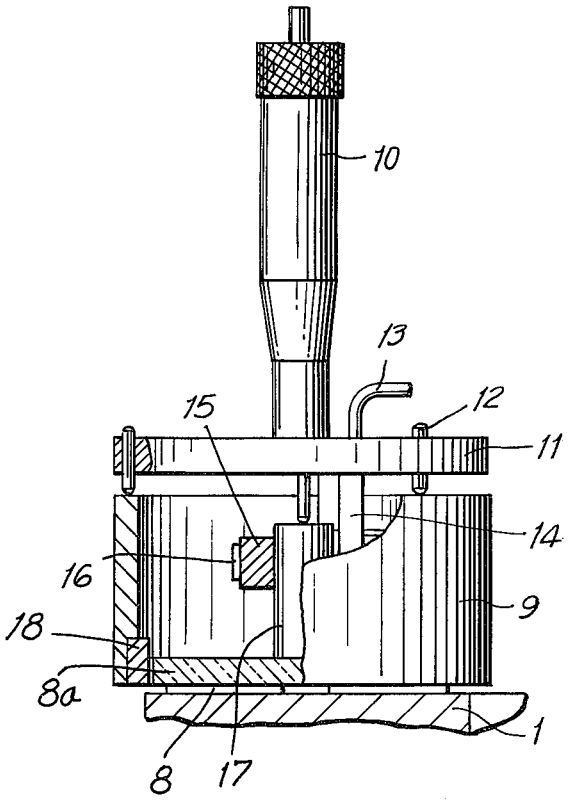
Figure 3:
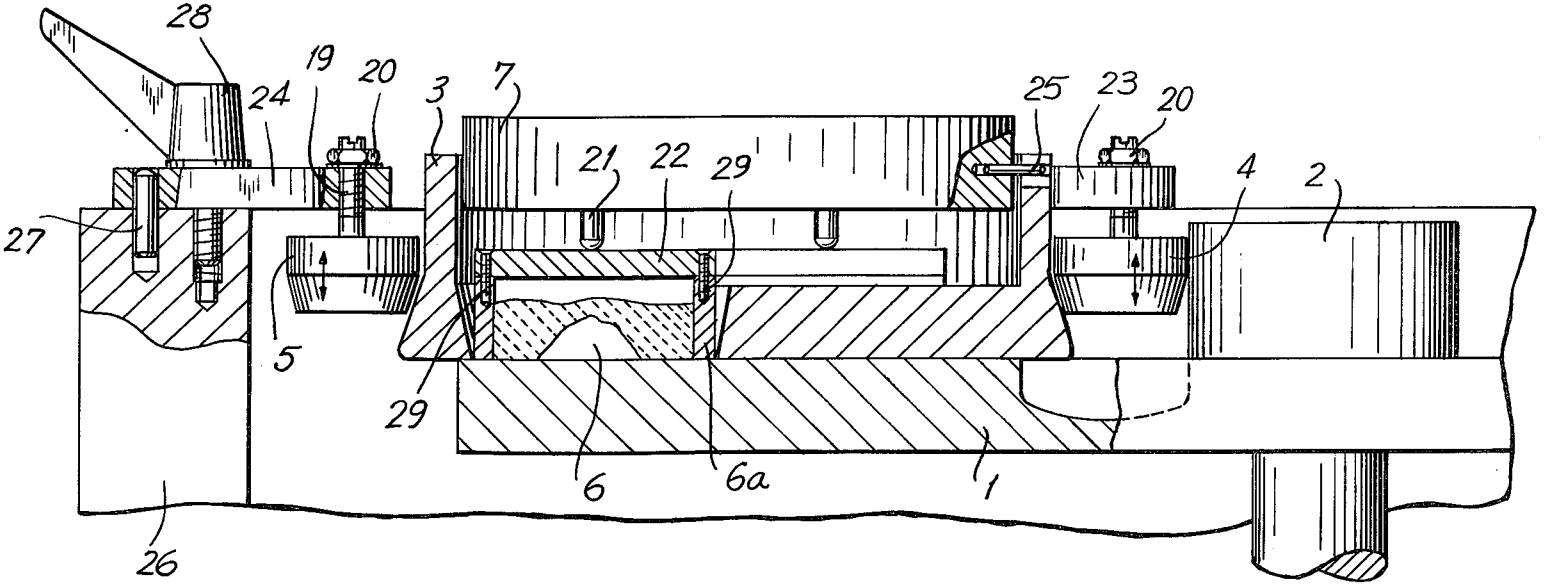

Other objects and many of the attendant advantages of the invention will be readily appreciated as the same becomes better understood by reference to the following detailed description, when considered with the accompanying drawings, wherein FIG. 1 is a somewhat schematic overall top view of a device for making sections for specimens, including specimen supports both according to this invention (somewhat similar to FIG. 2 of the above-mentioned co-pending application);

FIG. 2 is a partly sectional front view of a specimen supports that can be used in the device of FIG. 1; and FIG. 3 is a sectional frontal view through the device of FIG. 1, corresponding to a section line 3 — 3 therein, to show further structural details of both the device and the specimen support therein.

The device, which includes the specimen supports, has therein a polishing wheel or disc 1 which has fixed in its center a driving roller 2 rotating together with the wheel. It is however also contemplated to have the roller loosely mounted or separately driven, including the direction opposite to that of the wheel. It will be seen from the correlation of FIGS. 1 and 2 that the latter shows the structure of a specimen support 3 in the overall arrangement of FIG. 1, FIG. 3 in turn constituting an angularly broken section as indicated in the drawing in the usual manner.

Wheel 1 has thereabove a number of the specimen supports 3 (e.g. four, as shown), identified as such in FIGS. 1 and 3 and in FIG. 2 with inner structural details at 9, with respective kinds of specimens therein, as will be explained somewhat later. Two intermediate driving rollers 4 are provided between roller 2 and the specimen supports, rollers 4 being respectively carried by arms 23 associated with a housing portion 26 of the specimen mounting device.

Supporting or braking rollers 5 are carried by smaller support arms 24, similarly associated with housing portion 26. Arms 23, 24 are removable from housing 26 by the aid of securing pins 27 and with handles, preferably in the form of wing nuts, 28, as shown in FIG. 3 for one of the arms 24 (but not for 23 which falls outside the section).

Support arms 23 also have thereon supporting rollers 5*a*, at locations spaced away from rollers 4 thereon. Rollers 5, 5*a* prevent simultaneous rotation of specimen supports 3, 9.

Rollers 4, 5, 5*a* have envelopes constituted partly by a cylindrical and partly by a somewhat conical surface, as shown in FIG. 3 for rollers 4 and 5. These rollers are supported in a loosely rotatable manner by respective bolts 19 having threads at least in their upper portions, thereby allowing axial adjustment by the aid of respective immobilizing nuts 20.

The rollers effectively engage corresponding cylindrical and oppositely tapering peripheral portions of specimen holders 3 (see again FIG. 3). This arrangement allows the pressure onto the working wheel surface to be regulated, in a novel manner, and also the larger or more intense removal effect on the polishing wheel transferred or shifted from its outer periphery to more inward surface areas thereof, and vice versa.

Considering that the specimen supports according to the invention are suitable for the treatment of both thin sections and ground surfaces, a specimen 6 of the latter kind is shown in FIG. 3 within support 3, that is to be ground on its surface, while thin-section specimens 8 are illustrated in FIG. 2 between wheel 1 and support 9.

Dealing first with the details of FIG. 2, this support structure can be inserted into one of the supports 3 of FIG. 1 or into one of the supports 9 (forming part of FIG. 2), and serves for the preparation of accurately reproducible thin sections. A glass plate 8*a* is shown on which preferably three or more specimens 8 can be attached, e.g. with an adhesive or with a suitable putty. Each support 9 has therein a measuring device, for example in the form of a screw-type micrometer 10 with which the degree of lowering of the specimens can be preset, thereby controlling the material removal therefrom.

An adjusting plate 11 has therein preferably three limiting pins 12 (only two being visible), distributed close to the periphery of the plate, which come to rest on a top edge of support 9 when the preset degree of material removal has been attained.

A lever 13 with eccentric action controls a prismatic guide 14 within support 9, clamping being accomplished by the aid of a tensioning bridle 15 in cooperation with two lateral tightening bolts 16. Glass plate 8*a* is associated with a guide cylinder 17, and it has a notch on its periphery which engages a driver 18 of support 9, as shown. This prevents inadvertent rotation of plate 8*a* with respect to the support. In its position with respect to plate 11, cylinder 17 can be fixed with the previously described elements 13 to 16.

Coming now to the support structure shown in FIG. 3, serving for the preparation of ground specimen surfaces, an appropriate number of supporting rings 6*a* is provided within each support 3 for specimens 6. A weight 7 is placed on top of the structure (not identified in FIG. 1), which has one or more depending pressing bolts 21 that contact pressing plates 22 in the areas of specimens 6.

Support 3 may have therein three conical bores for the specimens, the contacting surfaces between holders 3 and rings 6*a* being angularly tapered so that pull-out or breakdown torque effects are substantially eliminated.

It should be noted that weight 7 can be substituted by an appropriate spring means (not shown).

When specimens 6 to be ground within rings 6*a* are processed, a follower pin 25 prevents weight 7 from following the movement of the associated specimen support 3. Two holding pins 29 immobilize pressing plate 22 with respect to rings 6*a*.

It should be understood, of course, that the foregoing disclosure relates only to preferred embodiments of the invention, and that it is intended to cover all changes and modifications of the examples and features described which do not constitute departures from the spirit and scope of the invention.

We claim:

1. A device for making sections for specimens, for thin sections and ground surfaces of metallographic specimens for microscopic analyses, comprising a housing; a rotatable polishing wheel therein; frictional drive means disposed centrally on said wheel and rotating therewith; at least two specimen supports symmetrically carried above said wheel in a freely rotatable, removable and interchangeable manner; at least one intermediate roller pivotally supported adjacent the peripheries of a pair of adjacent ones of said supports for transmitting to the latter rotation from said drive means in a direction identical with that of said wheel; said supports as well as said roller having complementary interengaging peripheral surfaces that are partly cylindrical and partly conical; and means for adjusting the location and degree of interengagement between the respective surfaces.

2. The device as defined in claim 1, wherein at least one pair of said engaging surfaces is located slightly above the level of said polishing wheel.

3. The device as defined in claim 1, wherein said adjusting means is centrally disposed in said at least two specimen supports.

4. The device as defined in claim 1, further comprising limiting means engaging peripheral portions of said at least two specimen supports for presetting the lowering distance thereof toward said polishing wheel until a predetermined degree of material removal by the latter has been attained.

5. The device as defined in claim 4, wherein said limiting means includes a plate above said specimen support, at least one limiting pin passing through said plate, a substantially axial prismatic guide with clamping means, a guide cylinder, and a glass bottom plate associated with said cylinder, above a specimen when inserted in the respective support.

6. The device as defined in claim 1, further comprising means for pivotally securing said at least one intermediate roller to said housing.

7. The device as defined in claim 6, wherein said securing means is constituted by at least one arm pivotally supported on said housing and carrying said at least one roller thereon.

8. The device as defined in claim 1, further comprising a weight for urging a specimen in one of said specimen supports toward said polishing wheel.

9. The device as defined in claim 1, further comprising spring means for urging the specimen toward said polishing wheel.

10. The device as defined in claim 1, further comprising at least one braking roller engaging one of said at least two specimen supports and urging the same toward said drive means.

11. The device as defined in claim 10, further comprising means for removably securing said at least one braking roller to said housing.

12. The device as defined in claim 10, wherein said at least one braking roller also has peripheral surfaces that are partly cylindrical and partly conical, for selective engagement with such surfaces of said at least two specimen supports.

13. The device as defined in claim 1, wherein said at least two specimen supports have conical inner recesses for receiving and immobilizing specimens therein.

* * * * *